US009534827B2

(12) United States Patent
Sato et al.

(10) Patent No.: US 9,534,827 B2
(45) Date of Patent: Jan. 3, 2017

(54) AIR HEAT EXCHANGER

(75) Inventors: Wataru Sato, Tokyo (JP); Shigeyuki Sasaki, Tokyo (JP)

(73) Assignee: JOHNSON CONTROLS-HITACHI AIR CONDITIONING TECHNOLOGY (HONG KONG) LIMITED, Kln (HK)

( * ) Notice: Subject to any disclaimer, the term of this patent is extended or adjusted under 35 U.S.C. 154(b) by 224 days.

(21) Appl. No.: 14/405,408

(22) PCT Filed: Jun. 7, 2012

(86) PCT No.: PCT/JP2012/064631
§ 371 (c)(1),
(2), (4) Date: Dec. 4, 2014

(87) PCT Pub. No.: WO2013/183136
PCT Pub. Date: Dec. 12, 2013

(65) Prior Publication Data
US 2015/0211781 A1 Jul. 30, 2015

(51) Int. Cl.
*F25D 21/14* (2006.01)
*F28F 17/00* (2006.01)
(Continued)

(52) U.S. Cl.
CPC ..... *F25D 21/14* (2013.01); *F28D 1/05383* (2013.01); *F28F 1/128* (2013.01); *F28F 1/325* (2013.01);
(Continued)

(58) Field of Classification Search
CPC ..... F25D 21/14; F24F 13/222; F28D 1/0477; F25B 39/04
(Continued)

(56) References Cited

U.S. PATENT DOCUMENTS 5,207,074 A * 5/1993 Cox ..... F24F 1/0007 165/127
7,165,416 B2 * 1/2007 Lee ..... F24F 12/006 62/285

FOREIGN PATENT DOCUMENTS

JP 2005-24187 A 1/2005
JP 2005-241168 A 9/2005
(Continued)

*Primary Examiner* — Melvin Jones
(74) *Attorney, Agent, or Firm* — Baker Botts L.L.P.

(57) ABSTRACT

Provided is an air heat exchanger capable of preventing an increase in ventilation resistance and a decrease in heat exchange efficiency due to condensation water generated on surfaces of heat transfer fins, without increasing thermal resistance of flat tubes and the heat transfer fins, and preventing scattering of water droplets downwind from the heat transfer fins. In the air heat exchanger including a plurality of flat tubes 2 and heat transfer fins 5 provided between the flat tubes 2 and on which air is blown, the flat tubes 2 include water draining grooves 4 on side surfaces on which the heat transfer fins 5 are provided and the heat transfer fins 5 include water guiding grooves 6 communicating with the water draining grooves 4. At least a groove wall 40 on the upwind side of an air blowing direction 10 among groove walls forming the water guiding grooves 6 is provided from a position of the upwind side from the water draining grooves 4 to the water draining grooves 4. The water guiding grooves 6 extend toward the water draining grooves 4 along the groove wall 40 on the upwind side and an area of a cross section perpendicular to an extension direction decreases toward the water draining grooves 4.

8 Claims, 8 Drawing Sheets

(51) Int. Cl.

| | |
|---|---|
| ***F28D 1/053*** | (2006.01) |
| ***F28F 1/12*** | (2006.01) |
| ***F28F 1/32*** | (2006.01) |
| *F28D 21/00* | (2006.01) |

(52) U.S. Cl.
CPC ..... *F28F 17/005* (2013.01); *F28D 2021/0071* (2013.01)

(58) Field of Classification Search
USPC ... 62/285, 286, 291, 419, 515; 165/127, 150
See application file for complete search history.

(56) References Cited

FOREIGN PATENT DOCUMENTS

| | | | |
|---|---|---|---|
| JP | 2008-116095 | A | 5/2008 |
| JP | 2010-25476 | A | 2/2010 |
| JP | 2010-25482 | A | 2/2010 |
| JP | 2012-72955 | A | 4/2012 |
| WO | 2009/044593 | A1 | 4/2009 |

* cited by examiner

AIR HEAT EXCHANGER

TECHNICAL FIELD

The present invention relates to an air heat exchanger that includes flat tubes and heat transfer fins.

BACKGROUND ART

An air heat exchanger includes two tubular headers through which a cooling medium flows, a plurality of flat tubes arranged to couple the two headers, and a plurality of heat transfer fins provided between the plurality of flat tubes. Each of the flat tubes is orthogonal to the header and each of the heat transfer fins is orthogonal to the flat tube. A plurality of minute flow channels communicating from the headers are formed in the flat tubes. The cooling medium flows from the header to the flat tube through the flow channel. Each of the header, the flat tube, and the heat transfer fin is formed of a metal material having high thermal conductivity, for example, aluminum. These members are bonded to each other by a brazing material or an adhesive material. Air is blown on the air heat exchanger having such a structure using a fan and the air is introduced into the air heat exchanger.

In the air heat exchanger, a heat exchange of the cooling medium and the air is performed. The cooling medium is introduced into the header and is then distributed to the flat tube through the flow channel. Hot heat or cold heat of the cooling medium introduced into the flat tube is transmitted from the flat tube to the heat transfer fin to expand a heat transfer area and performs a heat exchange with the air flowing between the heat transfer fins.

However, when the air heat exchanger is used as an evaporator, temperatures of surfaces of the flat tube and the heat transfer fin are lower than a temperature of the air. For this reason, when the air passes between the heat transfer fins, moisture in the air condenses into the surface of the heat transfer fin. In the air heat exchanger in which the flat tubes are arranged to extend in a gravity direction and the heat transfer fins are arranged horizontally, condensation water generated on the surfaces of the heat transfer fins is rarely moved by an action of gravity and the condensation water is hard to be drained. In addition, if the condensation advances and a large amount of condensation water stays between the heat transfer fins, the condensation water may occlude between the heat transfer fins. If between the heat transfer fins are occluded, ventilation resistance of the air heat exchanger increases, which results in deteriorating heat exchange efficiency of the cooling medium and the air. In addition, the condensation water is swept by ventilation air and is scattered on the downwind side of the heat transfer fins and water droplets are blown out from the air heat exchanger.

For this reason, a structure for efficiently draining the condensation water generated in the heat transfer fins in the air heat exchanger is studied. For example, PTL 1 discloses an air heat exchanger in which openings are provided in heat transfer fins to drain condensation water on surfaces of the heat transfer fins. In addition, PTL 2 discloses an air heat exchanger in which condensation water is dropped by inclining heat transfer fins.

CITATION LIST

Patent Literature

PTL 1: JP 2005-24187 A
PTL 2: JP 2008-116095 A

SUMMARY OF INVENTION

Technical Problem

In the air heat exchangers according to the related art disclosed in PTL 1 and PTL 2, the condensation water generated on the surfaces of the heat transfer fins is drained to a lower portion of the air heat exchanger using the gravity. Because the water droplets generated by the condensation water is minute in an initial step of formation, an influence of surface tension is large as compared with an influence of the gravity. For this reason, in the air heat exchanger in which the water is drained using only the gravity, the water is hard to be drained until the water droplets are grown, the ventilation resistance increases, and the heat exchange efficiency is deteriorated. In the heat exchanger having the structure in which the heat transfer fins are inclined, assembling is difficult. For example, when the heat transfer fins are blazed to the flat tubes, fixed positions of the heat transfer fins are easy to be shifted by expansion and deformation of the flat tubes and contacts of the flat tubes and the heat transfer fins are easy to become irregular. In addition, in the structure in which the openings are provided in the heat transfer fins, a heat transfer area of the heat transfer fins decreases and a contact area of the heat transfer fins and the flat tubes decreases. For this reason, thermal resistance of the flat tubes and the heat transfer fins increases.

An object of the invention is to provide an air heat exchanger capable of preventing an increase in ventilation resistance and a decrease in heat exchange efficiency due to condensation water generated on surfaces of heat transfer fins, without increasing thermal resistance of flat tubes and the heat transfer fins, and preventing scattering of water droplets downwind from the heat transfer fins.

Solution to Problem

An air heat exchanger according to the invention has the following characteristics.

An air heat exchanger includes a plurality of flat tubes and heat transfer fins provided between the flat tubes and on which air is blown, and in the air heat exchanger, the flat tubes include water draining grooves on side surfaces on which the heat transfer fins are provided, and the heat transfer fins include water guiding grooves communicating with the water draining grooves. At least a groove wall on the upwind side of an air blowing direction among groove walls forming the water guiding grooves is provided from a position of the upwind side from the water draining grooves to the water draining grooves, and the water guiding grooves extend toward the water draining grooves along the groove wall on the upwind side and an area of a cross section perpendicular to an extension direction decreases toward the water draining grooves.

Advantageous Effects of Invention

According to the invention, an air heat exchanger capable of preventing an increase in ventilation resistance and a decrease in heat exchange efficiency due to condensation water generated on surfaces of heat transfer fins, without increasing thermal resistance of flat tubes and the heat transfer fins, and preventing scattering of water droplets downwind from the heat transfer fins can be provided.

DESCRIPTION OF EMBODIMENTS

Figure 1:
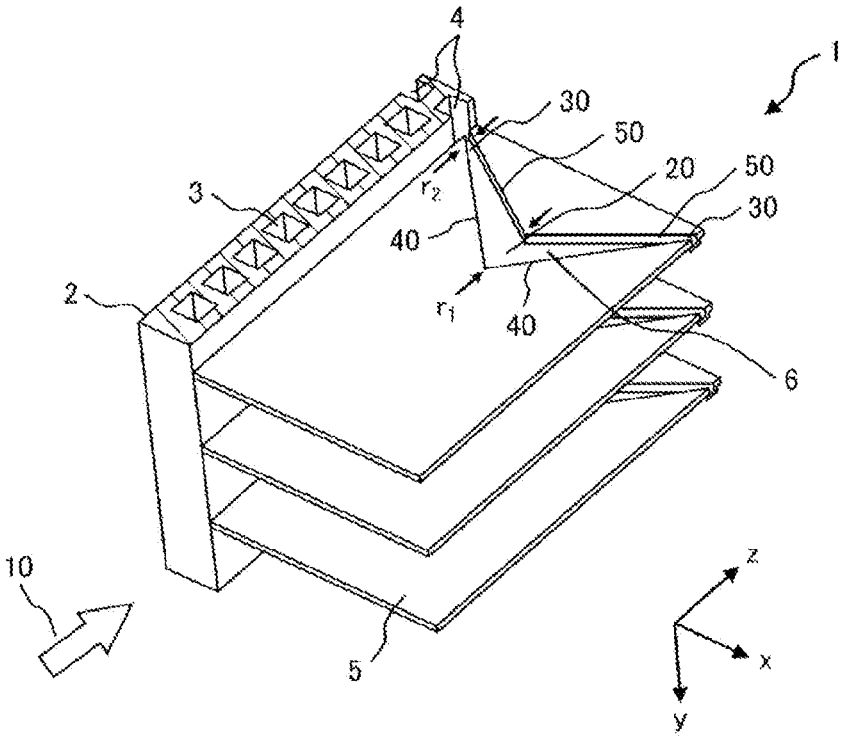
FIG. 1 is a partial perspective view of an air heat exchanger according to a first embodiment and a diagram illustrating a flat tube and a heat transfer fin.

An air heat exchanger according to the present invention drains condensation water generated on surfaces of heat transfer fins using surface tension and fluid force (wind force of a fan) as well as gravity. For this reason, it is possible to prevent an increase in ventilation resistance and a decrease in heat exchange efficiency due to the condensation water, without increasing thermal resistance of flat tubes and the heat transfer fins, and it is possible to prevent scattering of water droplets downwind from the heat transfer fins.

The air heat exchanger according to the present invention includes the flat tubes provided with water draining grooves in a longitudinal direction and the heat transfer fins provided with water guiding grooves. Among groove walls forming the water guiding grooves, a groove wall on the upwind side of an air blowing direction is provided from a position of the upwind side from the water draining groove to a communicating portion communicating with the water draining groove. Among the groove walls forming the water guiding grooves, a groove wall on the downwind side of the air blowing direction may be provided from the position of the upwind side from the water draining groove to the water draining groove, may be provided from the position of the downwind side to the water draining groove, or may be provided at the same position as the water draining groove in the air blowing direction. In this way, the water guiding grooves are formed to extend toward the communicating portions with the water draining grooves along the groove wall on the upwind side and communicate with the water draining grooves.

The condensation water generated on the surfaces of the heat transfer fins is swept into the water guiding grooves by the wind force of the fan, flows to the water draining grooves by the surface tension in the water guiding grooves, and is discharged to a lower portion of the air heat exchanger by the gravity. In the water guiding grooves, an area of a cross section perpendicular to an extension direction (hereinafter, simply referred to as the "area of the cross section") decreases toward the communicating portions with the water guiding grooves to drain the water by the action of the surface tension. For example, one of a width and a depth of the water guiding grooves or both the width and the depth are changed, so that the area of the cross section of the water guiding grooves can decrease toward the communicating portions with the water draining grooves. The area of the cross section of the water guiding grooves may decrease smoothly (gradually) or may decrease stepwise.

Although the details are described below, force proportional to the radius of curvature of the water droplets is applied to the water droplets of the water guiding grooves due to the surface tension. Therefore, force is applied to the water droplets, from the side where the radius of curvature is large to the side where the radius of curvature is small, that is, from the side where the area of the cross section of the water guiding grooves is large to the side where the area of the cross section is small. Thus, if the area of the cross section of the water guiding grooves decreases toward the communicating portions with the water draining grooves, the water droplets in the water guiding grooves keep getting wet toward the water draining grooves by the force applied from the side where the area of the cross section is large to the side where the area of the cross section is small.

Hereinafter, embodiments of the air heat exchanger according to the present invention will be described using the drawings.

First Embodiment

An air heat exchanger according to a first embodiment of the present invention will be described in detail. This embodiment is an example of the case in which a width of water guiding grooves decreases gradually toward communicating portions with water draining grooves to decrease an area of a cross section of the water guiding grooves.

FIG. 1 is a partial perspective view of an air heat exchanger 1 according to the first embodiment and illustrates a flat tube 2 and a heat transfer fin 5. On the air heat exchanger 1, air is blown by a fan (not illustrated in the drawings). In the drawing, an X axis shows a width direction of the air heat exchanger 1. An X-axis direction is also a width direction of the heat transfer fin 5. In addition, a positive direction of a Y axis shows a gravity direction and a positive direction of a Z axis shows an air blowing direction 10 of the air by the fan. Words "upwind" and "downwind" used in the following description show directions for the air blowing direction 10. That is, the upwind side shows the negative direction side of the Z axis and the downwind side shows the positive direction side of the Z axis.

The air heat exchanger 1 includes the plurality of flat tubes 2 and the plurality of heat transfer fins 5 provided to be orthogonal to the flat tubes 2 between the flat tubes 2. In FIG. 1, only one flat tube 2 is illustrated to facilitate display. In FIG. 1, headers arranged at upper and lower sides (both ends of a Y-axis direction) of the flat tube 2 are not illustrated in the drawings. The heat transfer fins 5 may have a corrugated shape.

In the flat tube 2, a plurality of minute flow channels 3 through which a cooling medium flows are formed. In addition, in the flat tube 2, water draining grooves 4 extending in a length direction (the Y-axis direction) are formed on both side surfaces (surfaces provided with the heat transfer fins 5) of the X-axis direction. The water draining groove 4 communicates from an upper end to a lower end of the Y-axis direction and is opened toward a positive direction or a negative direction of the X axis and a positive direction and a negative direction of the Y axis. That is, the water draining groove 4 is opened toward the heat transfer fin 5 and is opened in a vertical direction. A position of the water draining groove 4 of the flat tube 2 in the air blowing direction 10 (Z-axis direction) may be arbitrary, but the water draining groove 4 is preferably formed in one end (one end of the positive direction of the Z axis) of the downwind side.

Both side surfaces of the heat transfer fin 5 in the width direction (X-axis direction) are connected to the flat tube 2 and the heat transfer fin 5 is orthogonal to the flat tube 2. In addition, the heat transfer fin 5 has a water guiding groove 6 communicating with the water draining groove 4 of the flat tube 2.

Among groove walls forming the water guiding groove 6, a groove wall 40 on the upwind side (the negative direction side of the Z axis) is provided from a position of the upwind side from the water draining groove 4 to the communicating portion 30 communicating with the water draining groove 4. In this embodiment, among the groove walls forming the water guiding groove 6, a groove wall 50 on the downwind side (the positive direction side of the Z axis) is provided from a position of the upwind side from the water draining groove 4 to the water draining groove 4. In this way, the water guiding groove 6 extends toward the communicating portion with the water draining groove 4 and communicates with the water draining groove 4.

In this embodiment and the following embodiments, a portion of the most upwind side of the water guiding groove (the negative direction side of the Z axis) is referred to as an "upwind end portion 20". Therefore, the communicating portion 30 of the water guiding groove 6 communicating with the water draining groove 4 is positioned at the downwind side (the positive direction side of the Z axis) from the upwind end portion 20 of the water guiding groove 6. A position of the upwind end portion 20 of the water guiding groove 6 in a width direction (X-axis direction) of the heat transfer fin 5 can be arbitrarily determined.

In this embodiment, the water draining grooves 4 of the flat tube 2 exist on both side surfaces of the width direction (X-axis direction) of the heat transfer fin 5. Because the heat transfer fin 5 is interposed by the two flat tubes 2, the water guiding groove 6 includes the two communicating portions 30 that communicate with the water draining grooves 4, respectively. Therefore, the water guiding groove 6 has a V shape formed to extend from the upwind end portion 20 to the two communicating portions 30. The water guiding groove 6 has a function of discharging the condensation water generated on the surface of the heat transfer fin 5 to the water draining groove 4. The condensation water generated on the surface of the heat transfer fin 5 is swept into the water guiding groove 6 by the wind force of the fan, flows to the water draining groove 4 through the water guiding groove 6 by the surface tension, and is discharged from the water draining groove 4. The principle of flowing the condensation water along the water guiding groove 6 by the action of the surface tension will be described below using FIG. 6.

A preferred position of the upwind end portion 20 of the water guiding groove 6 can be determined according to the velocity of the wind blown by the fan or the area of the heat transfer fin 5. The position of the upwind end portion 20 of the water guiding groove 6 in the air blowing direction 10 (Z-axis direction) is preferably closer to the downwind side (the positive direction side of the Z axis) if possible (however, the position is at the upwind side (the negative direction side of the Z axis) from the water draining groove 4). In order to discharge the condensation water generated on the surface of the heat transfer fin 5 to the water draining groove 4 as much as possible, it is necessary to position the upwind end portion 20 of the water guiding groove 6 to be closer to the downwind side if possible.

On the surface of the heat transfer fin 5, the condensation water is generated mainly at the upwind side (the negative direction side of the Z axis) and the condensation water is rarely generated at the downwind side (the positive direction side of the Z axis). Therefore, the upwind end portion 20 of the water guiding groove 6 is positioned to be closer to the downwind side if possible, so that most of the condensation water can be discharged. In addition, the position of the upwind end portion 20 of the water guiding groove 6 can be determined such that a region of the surface of the heat transfer fin 5 in which the condensation water is rarely generated is positioned at the downwind side from the water guiding groove 6.

The width of the water guiding groove 6 decreases gradually from the upwind end portion 20 to the communicating portion 30 with the water draining groove 4. That is, in the water guiding groove 6, a width $r_1$ of the upwind end portion 20 and a width $r_2$ of the communicating portion 30 are in a relation of $r_1>r_2$ and the width decreases gradually from the upwind end portion 20 to the communicating portion 30. Preferably, the widths $r_1$ and $r_2$ are in a relation of $r_1>2r_2$. Specific values of the width $r_1$ of the upwind end portion 20 and the width $r_2$ of the communicating portion 30 can be determined according to the velocity of the wind blown by the fan or the hydrophilic property of the heat transfer fin 5.

The depth of the water guiding groove 6 can be arbitrarily determined according to the velocity of the wind blown by the fan or the thickness and the hydrophilic property of the heat transfer fin 5.

In the example illustrated in FIG. 1, the water guiding groove 6 communicates from the upwind end portion 20 to the water draining groove 4 of the flat tube 2 connected to both side surfaces of the heat transfer fin 5, by the communicating portion 30 with the water draining groove 4. In addition, the upwind end portion 20 of the water guiding groove 6 is positioned at the center of the width direction (the X-axis direction) of the heat transfer fin 5. That is, the water guiding groove 6 is a groove of a V shape formed to expand from the upwind end portion 20 to the downwind side (the positive direction of the Z axis).

Figure 2:
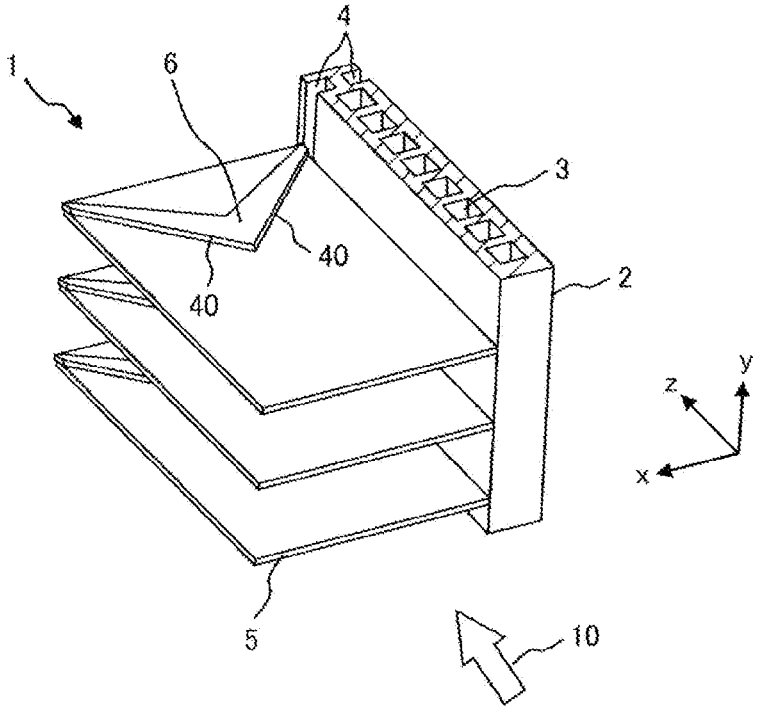
FIG. 2 is a partial perspective view of the air heat exchanger according to the first embodiment when the heat transfer fin is viewed from the lower side.

FIG. 2 is a partial perspective view of the air heat exchanger 1 when the heat transfer fin 5 is viewed from the lower side (the positive direction of the Y axis). In FIG. 2, the same reference numerals as those in FIG. 1 denote the same elements as those in FIG. 1 and explanation of these elements is omitted.

If the heat transfer fin 5 is viewed from the lower side (the positive direction of the Y axis), the water guiding groove 6 of the heat transfer fin 5 has a convex shape. That is, the water guiding groove 6 protrudes from a bottom surface of the heat transfer fin 5 to the lower side (the positive direction of the Y axis).

Figure 3:
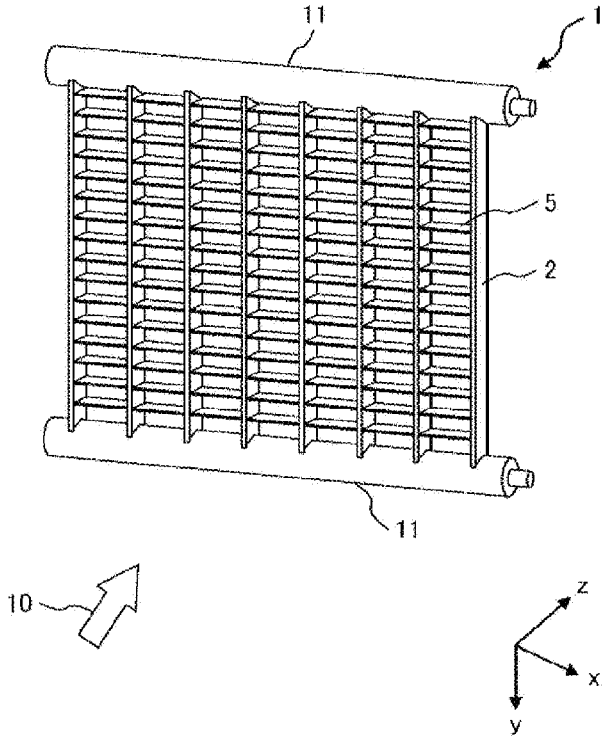
FIG. 3 is a perspective view illustrating an entire portion of the air heat exchanger according to the first embodiment.

FIG. 3 is a perspective view illustrating an entire portion of the air heat exchanger 1 according to the first embodiment of the present invention. The air heat exchanger 1 includes two headers 11 through which a cooling medium flows, a plurality of flat tubes 2 fixed to couple the headers 11, and a plurality of heat transfer fins 5 provided between the flat tubes 2. A plurality of flow channels through which the cooling medium flows are formed in each flat tube 2 and the cooling medium is distributed from the header 11. On the air heat exchanger 1, air is blown in the air blowing direction 10 by a fan (not illustrated in the drawings).

In the air heat exchanger 1, a heat exchange of the cooling medium and the air is performed. Hot heat and cold heat of the cooling medium flowing through the flow channels in the flat tube 2 are transmitted from the flat tube 2 to the heat transfer fin 5 to expand a heat transfer area and efficiently perform a heat exchange with the air flowing between the heat transfer fins 5.

The condensation water flowing from the heat transfer fin 5 to the water draining groove 4 of the flat tube 2 through the water guiding groove 6 is drained to the header 11 provided in a lower portion of the flat tube 2 using the gravity.

In the flat tubes 2 on both ends of the width direction (X-axis direction) of the air heat exchanger 1, the water draining grooves 4 may be formed on only a single surface provided with the heat transfer fins 5 or the water draining grooves 4 may be formed on both side surfaces of the width direction.

Figure 4:
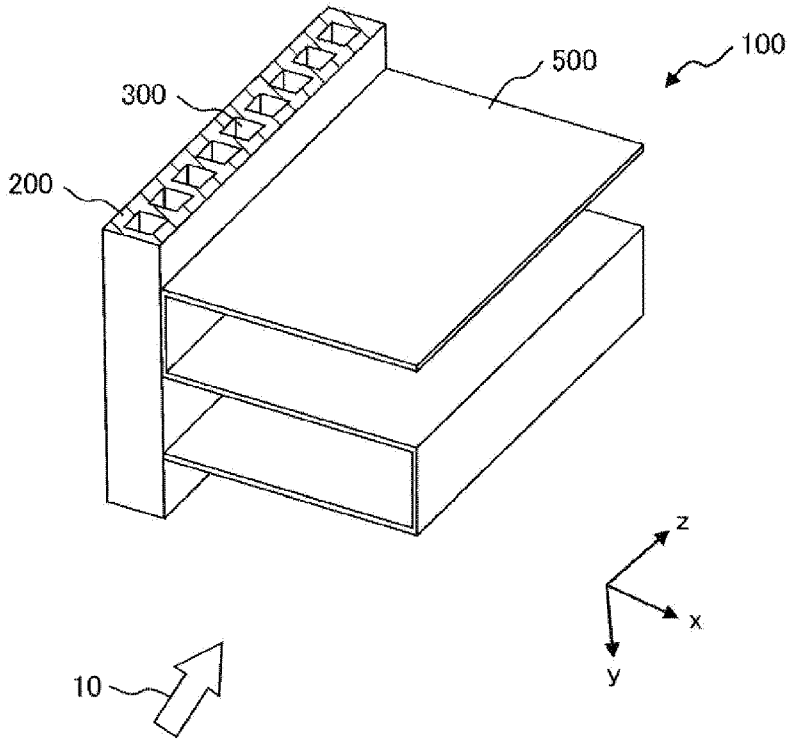
FIG. 4 is a partial perspective view of an air heat exchanger according to the related art and a diagram illustrating a flat tube and a heat transfer fin.

FIG. 4 is a partial perspective view of an air heat exchanger 100 according to the related art and illustrates a flat tube 200 and a heat transfer fin 500. Similarly to FIG. 1, FIG. 4 illustrates only one flat tube 200 and does not illustrate headers. Directions shown by the coordinate axes are also the same as those in FIG. 1. In the flat tube 200, a plurality of flow channels 300 through which a cooling medium flows are formed. The heat transfer fin 500 is attached to be orthogonal to the flat tube 200 and has a corrugated shape. On the air heat exchanger 100, air is blown in an air blowing direction 10 by a fan (not illustrated in the drawings).

A discharge path of condensation water generated on a surface of the heat transfer fin 500 in the air heat exchanger 100 according to the related art will be described. If the heat exchanger 100 is used as an evaporator, a surface temperature of the flat tube 200 becomes lower than a temperature of the air. For this reason, on the surfaces of the flat tube 200 and the heat transfer fin 500, moisture in the air condenses and water droplets are generated.

Figure 5:
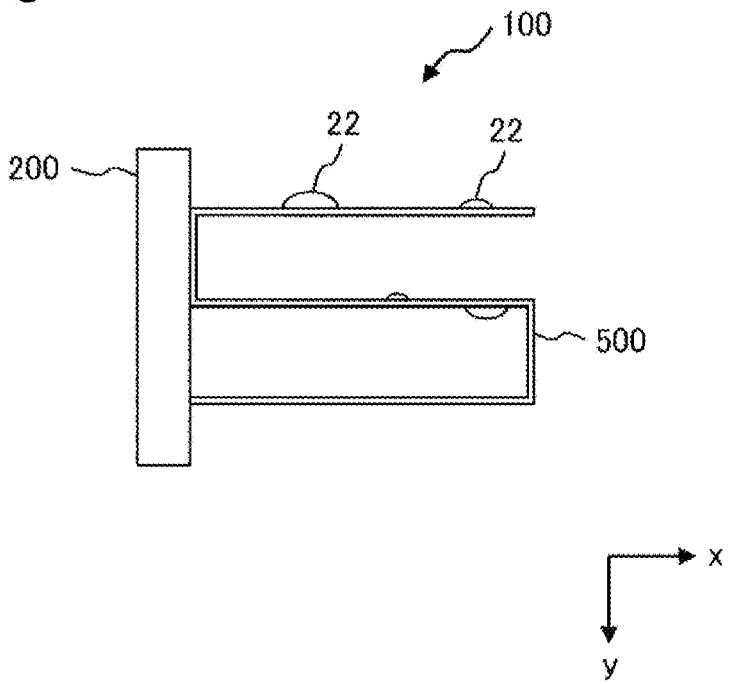
FIG. 5 is a partial lateral view of the air heat exchanger according to the related art when viewed from an air blowing direction.

FIG. 5 is a partial lateral view of the air heat exchanger 100 according to the related art illustrated in FIG. 4 when viewed from the air blowing direction 10 (Z-axis direction). As illustrated in FIG. 5, in the air heat exchanger 100 according to the related art, there is no path through which condensation water 22 is drained and the condensation water is easy to stay on the surface of the heat transfer fin 500 in a form of the water droplets. In addition, the water droplets (condensation water 22) generated on the surface of the heat transfer fin 500 are grown gradually and occlude a part of gaps between the heat transfer fins 500. If the gaps between the heat transfer fins 500 are occluded, there is a problem in that pressure loss of the air side increases, ventilation resistance of the air heat exchanger 100 increases, and heat exchange efficiency is deteriorated. In addition, there is a problem in that the condensation water 22 swept by the air is scattered on the downwind side of the heat transfer fin 500 and is blown out from the air heat exchanger 100.

Figure 6:
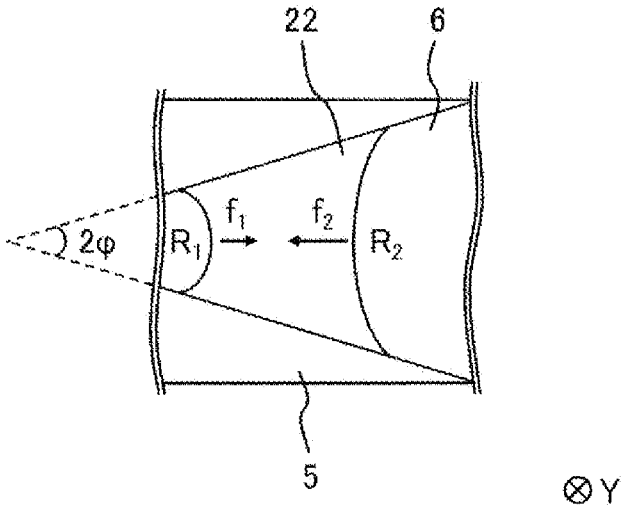
FIG. 6 is a partial top view of the heat transfer fin illustrating the water draining principle of condensation water generated on a surface of the heat transfer fin, in the first embodiment.

FIG. 6 is a diagram illustrating the water draining principle of the condensation water 22 generated on the surface of the heat transfer fin 5 and a top view schematically illustrating a part of the water guiding groove 6 formed in the heat transfer fin 5. FIG. 6 is a diagram illustrating the heat transfer fin 5 when viewed from an upward direction (the negative direction of the Y axis).

In FIG. 6, the width of the water guiding groove 6 decreases from the right side to the left side. That is, the upwind end portion 20 of the water guiding groove 6 exists at the right side of FIG. 6 and the communicating portion 30 of the water guiding groove 6 communicating with the water draining groove 4 exists at the left side thereof. In the water guiding groove 6, the condensation water 22 exists in a form of the water droplet illustrated in FIG. 6. After the water droplet of the condensation water 22 is generated on the surface of the heat transfer fin 5, the water droplet is swept into the water guiding groove 6 by the wind force of the fan.

FIG. 6 also illustrates capillary forces $f_1$ and $f_2$ generated in the condensation water 22 by the surface tension. $f_1$ shows force applied from the side of the communicating portion 30 with the water draining groove 4 in the water guiding groove 6 to the condensation water 22 and $f_2$ shows force applied from the side of the upwind end portion 20 in the water guiding groove 6 to the condensation water 22. $R_1$ shows the radius of curvature of an end of the side of the communicating portion 30 in the water droplet of the condensation water 22 and $R_2$ shows the radius of curvature of an end of the side of the upwind end portion 20. Because the width of the water guiding groove 6 decreases from the side of the upwind end portion 20 to the side of the communicating portion 30, $R_1<R_2$ is satisfied. $\phi$ shows a taper angle of the water guiding groove 6 (an angle representing a ratio in which the width of the water guiding groove 6 decreases).

The capillary forces $f_1$ and $f_2$ generated in the condensation water 22 are acquired by expressions (1) and (2). In the expressions (1) and (2), $\sigma$ shows surface tension applied to the condensation water 22 and $\theta$ shows a contact angle formed by the water guiding groove 6 and the condensation water 22.

[Formula 1]

$$f_1=2\pi\sigma R_1 \cos(\theta-\phi) \quad (1)$$

[Formula 2]

$$f_2=2\pi\sigma R_2 \cos(\theta+\phi) \quad (2)$$

When the surface of the heat transfer fin 5 is processed to have the hydrophilic property, the surface of the water guiding groove 6 also has the hydrophilic property. At this time, the contact angle θ formed by the water guiding groove 6 and the condensation water 22 is very small and can be considered as an angle close to zero. Therefore, because $R_1<R_2$ is satisfied, $f_1<f_2$ is obtained from the expressions (1) and (2). For this reason, the force applied from the side of the upwind end portion 20 to the side of the communicating portion 30 is applied to the condensation water 22 and the condensation water 22 keeps getting wet from the side where the width of the water guiding groove 6 is large to the side where the width thereof is small (the side of the communicating portion 30).

In the air heat exchanger 1 according to this embodiment, after the condensation water 22 generated on the surface of the heat transfer fin 5 is swept into the water guiding groove 6 by the wind force of the fan, the condensation water keeps getting wet toward the communicating portion 30 with the water draining groove 4 according to the principle by the surface tension applied to the condensation water 22 and is efficiently drained through the water draining groove 4 formed in the flat tube 2.

In addition, as illustrated in FIG. 2, on the bottom surface of the heat transfer fin 5, the water guiding groove 6 protrudes from the bottom surface of the heat transfer fin 5 to the lower side (the positive direction of the Y axis). The condensation water 22 generated on the bottom surface of the heat transfer fin 5 is swept into the protruding water guiding groove 6 by the wind force of the fan and is then swept into the water draining groove 4 along the water guiding groove 6. For this reason, on the bottom surface of the heat transfer fin 5, the condensation water 22 generated on the surface of the heat transfer fin 5 is discharged efficiently from the water draining groove 4.

As such, in the air heat exchanger 1 according to this embodiment, the condensation water generated on the surface of the heat transfer fin 5 is efficiently discharged at both the top surface and the bottom surface of the heat transfer fin 5. Therefore, it is possible to prevent an increase in ventilation resistance of the air heat exchanger 1 and a decrease in heat exchange efficiency and it is possible to prevent scattering of the water droplets downwind from the heat transfer fin 5.

In this embodiment, on the bottom surface of the heat transfer fin 5, the water guiding groove 6 protrudes to the lower side (the positive direction of the Y axis). However, on the bottom surface of the heat transfer fin 5, the water guiding groove 6 may not protrude to the lower side. According to manufacturing conditions of the heat transfer fins 5 such as the thickness of the heat transfer fin 5 or the processing method of the water guiding groove 6, it can be determined whether or not to protrude the water guiding groove 6 to the lower side. In addition, in embodiments to be described hereinafter, the bottom surface of the heat transfer fin 5 is not described. However, the water guiding groove may protrude to the lower side (the positive direction of the Y axis).

Second Embodiment

An air heat exchanger according to a second embodiment of the present invention will be described. This embodiment is an example of the case in which a heat transfer fin 5 includes a plurality of water guiding grooves 6 in the air heat exchanger 1 according to the first embodiment. In the air heat exchanger 1 according to the present invention, the number of water guiding grooves 6 formed in the heat transfer fin 5 is not limited to one and may be plural. Hereinafter, the air heat exchanger 1 including the heat transfer fin 5 having the plurality of water guiding grooves 6 will be described using the air heat exchanger 1 of the case in which the number of water guiding grooves 6 is two as an example. The following description can be applied to the case in which the number of water guiding grooves 6 is three or more.

Figure 7:
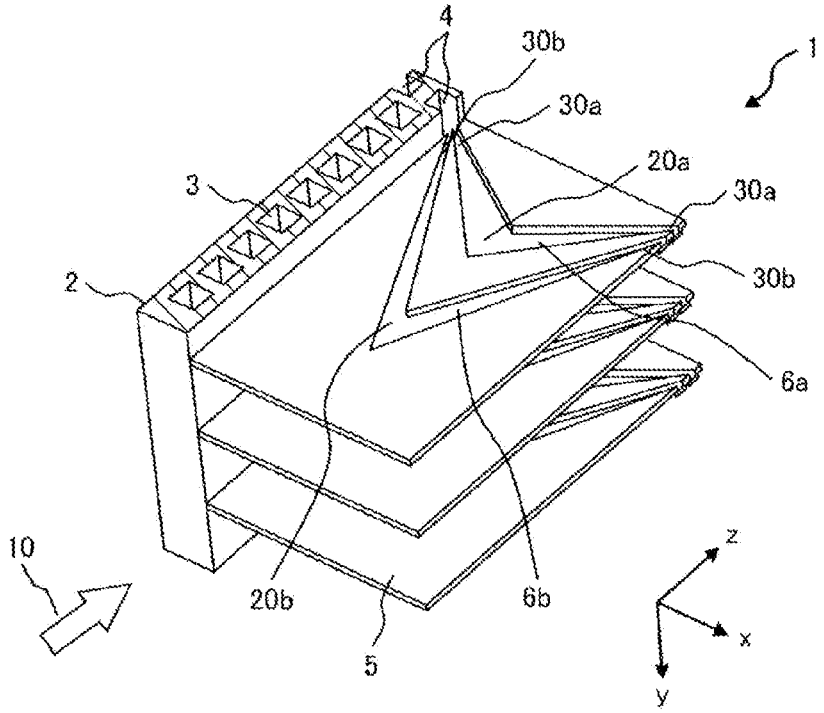
FIG. 7 is a partial perspective view of an air heat exchanger according to a second embodiment and a diagram illustrating the case in which one water draining groove is formed in each surface of a flat tube.
Figure 8:
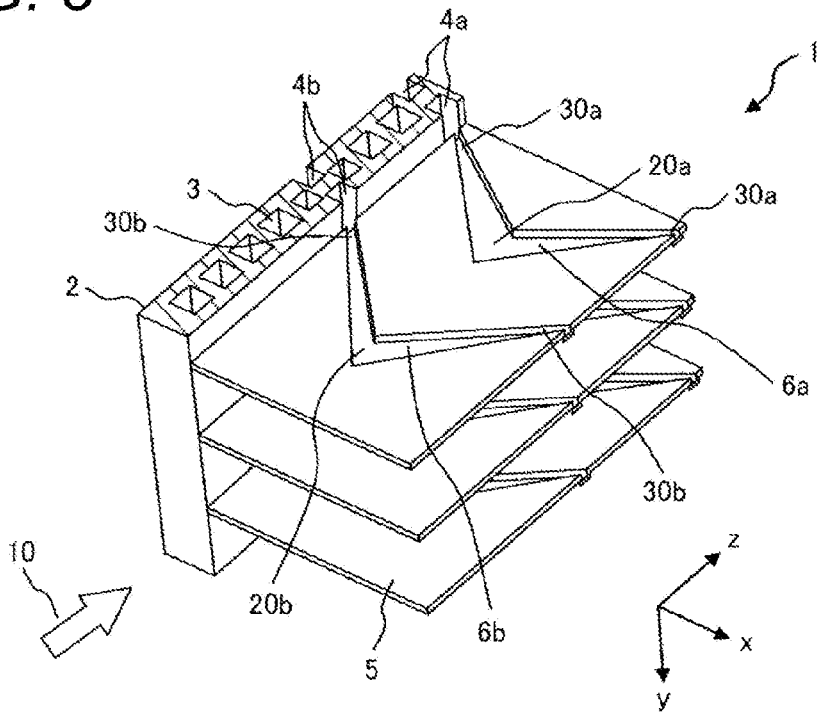
FIG. 8 is a partial perspective view of the air heat exchanger according to the second embodiment and a diagram illustrating the case in which two water draining grooves are formed in each surface of the flat tube.

FIGS. 7 and 8 are partial perspective views of the air heat exchanger 1 including the heat transfer fin 5 having the two water guiding grooves 6 and illustrate a flat tube 2 and the heat transfer fin 5. In FIGS. 7 and 8, the same reference numerals as those in FIG. 1 denote the same elements as those of FIG. 1 and explanation of these elements is omitted. In the air heat exchanger 1 illustrated in FIG. 7, one water draining groove 4 is formed in each side surface of an X-axis direction of the flat tube 2 and in the air heat exchanger 1 illustrated in FIG. 8, the two water draining grooves 4 are formed in each side surface of the X-axis direction of the flat tube 2.

In the heat transfer fin 5 of the air heat exchanger 1 illustrated in FIG. 7, two water guiding grooves **6*a* and 6*b* are formed in an air blowing direction 10 (a Z-axis direction) and the two water guiding grooves 6*a* and 6*b* communicate with a common water draining groove 4. Similarly to the first embodiment, both widths of the two water guiding grooves 6*a* and 6*b* decrease gradually from upwind end portions 20*a* and 20*b* to communicating portions 30*a* and 30*b* with the water draining groove 4. Both positions of the upwind end portions 20*a* and 20*b* of the water guiding grooves 6*a* and 6*b* in the air blowing direction 10 (the Z-axis direction) are at the upwind side (the negative direction side of the Z axis) from the water draining groove 4**.

The principle of discharging the condensation water generated on the surface of the heat transfer fin 5 is the same as that of the first embodiment. That is, the condensation water generated on the surface of the heat transfer fin 5 is swept into the water guiding groove **6*a* and the water guiding groove 6*b* by the wind force of the fan, flows to the water draining groove 4 through the water guiding groove 6*a* and the water guiding groove 6*b* by the surface tension, and is discharged from the water draining groove 4**.

In the heat transfer fin 5 of the air heat exchanger 1 illustrated in FIG. 8, the two water guiding grooves **6*a* and 6*b* are formed in the air blowing direction 10 (the Z-axis direction). In addition, two water draining grooves 4*a* and 4*b* are formed on each side surface of the X-axis direction of the flat tube 2. The water guiding groove 6*a* communicates with the water draining groove 4*a* from the upwind end portion 20*a* and the water guiding groove 6*b* communicates with the water draining groove 4*b* from the upwind end portion 20*b*. Similarly to the first embodiment, the widths of the two water guiding grooves 6*a* and 6*b* decrease gradually from the upwind end portions 20*a* and 20*b* to the communicating portions 30*a* and 30*b* with the water draining grooves 4*a* and 4*b*. A position of the upwind end portion 20*a* of the water guiding groove 6*a* in the air blowing direction 10 (the Z-axis direction) is at the upwind side (the negative direction side of the Z axis) from the water draining groove 4*a* and a position of the upwind end portion 20*b* of the water guiding groove 6*b* in the air blowing direction 10 is at the upwind side from the water draining groove 4*b***.

The principle of discharging the condensation water generated on the surface of the heat transfer fin 5 is the same as that of the first embodiment. That is, the condensation water generated on the surface of the heat transfer fin 5 is swept into the water guiding groove 6*a* and the water guiding groove 6*b* by the wind force of the fan, flows to the water draining grooves 4*a* and 4*b* through the water guiding groove 6*a* and the water guiding groove 6*b* by the surface tension, and is discharged from the water draining grooves 4*a* and 4*b*.

As in this embodiment, the plurality of water guiding grooves 6 are formed in the heat transfer fin 5, so that a distance until the condensation water generated on the surface of the heat transfer fin 5 arrives at the water guiding grooves 6*a* and 6*b* can be decreased, and the condensation water can be more efficiently discharged from the water draining groove 4 (or the water draining grooves 4*a* and 4*b*).

Third Embodiment

An air heat exchanger according to a third embodiment of the present invention will be described. This embodiment is an example of the case in which a width of a water guiding groove decreases stepwise toward a communicating portion with a water draining groove to decrease an area of a cross section of the water guiding groove.

Figure 9:
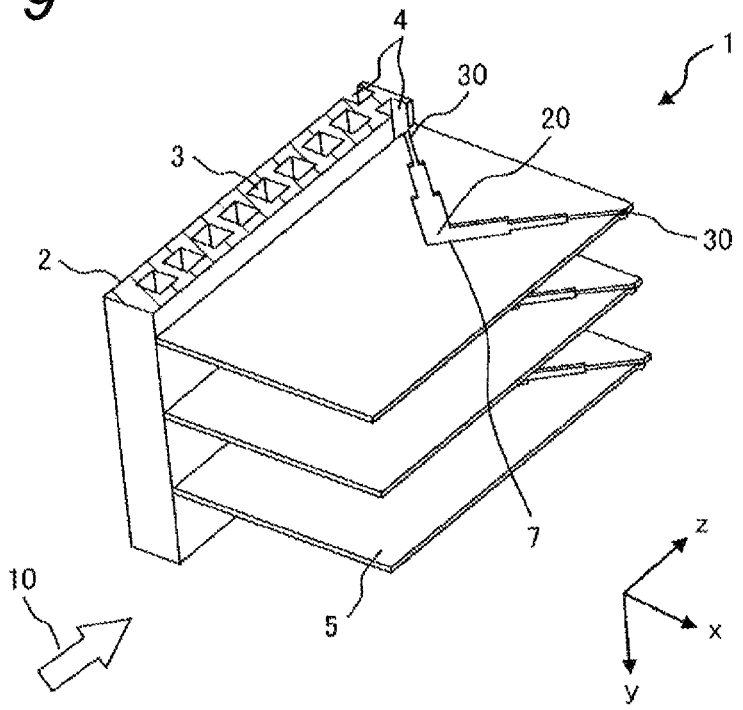
FIG. 9 is a partial perspective view of an air heat exchanger according to a third embodiment and a diagram illustrating a flat tube and a heat transfer fin.

FIG. 9 is a partial perspective view of an air heat exchanger 1 according to the third embodiment and illustrates a flat tube 2 and a heat transfer fin 5. In FIG. 9, the same reference numerals as those of FIG. 1 denote the same elements as those of FIG. 1 and explanation of these elements is omitted.

A water guiding groove 7 communicating with a water draining groove 4 is formed in the heat transfer fin 5. A width of the water guiding groove 7 decreases stepwise (in three steps in the example of FIG. 9) from an upwind end portion 20 to a communicating portion 30 with the water draining groove 4. A position of the upwind end portion 20 of the water guiding groove 7 in an air blowing direction 10 (a Z-axis direction) is at the upwind side (the negative direction side of a Z axis) from the water draining groove 4.

As in this embodiment, the water guiding groove 7 formed in the heat transfer fin 5 may have a shape in which the width thereof decreases gradually from the upwind end portion 20 to the communicating portion 30 and may not have a taper shape like the water guiding groove 6 according to the first embodiment illustrated in FIG. 1.

In FIG. 9, the width of the water guiding groove 7 decreases in the three steps as the example. However, the width may not decrease in the three steps. The number of steps in which the width of the water guiding groove 7 decreases may be arbitrarily determined.

Even in the air heat exchanger 1 according to this embodiment, after condensation water generated on a surface of the heat transfer fin 5 is swept into the water guiding groove 7 by the wind force of the fan, the condensation water keeps getting wet toward the communicating portion 30 with the water draining groove 4 according to the principle by the surface tension applied to the condensation water as illustrated in FIG. 6 and is drained efficiently through the water draining groove 4 formed in the flat tube 2. Therefore, the air heat exchanger according to this embodiment also has the same effect as that of the air heat exchanger according to the first embodiment.

Fourth Embodiment

An air heat exchanger according to a fourth embodiment of the present invention will be described. This embodiment is an example of the case in which a depth of a water guiding groove decreases gradually toward a communicating portion with a water draining groove to decrease an area of a cross section of the water guiding groove.

Figure 10:
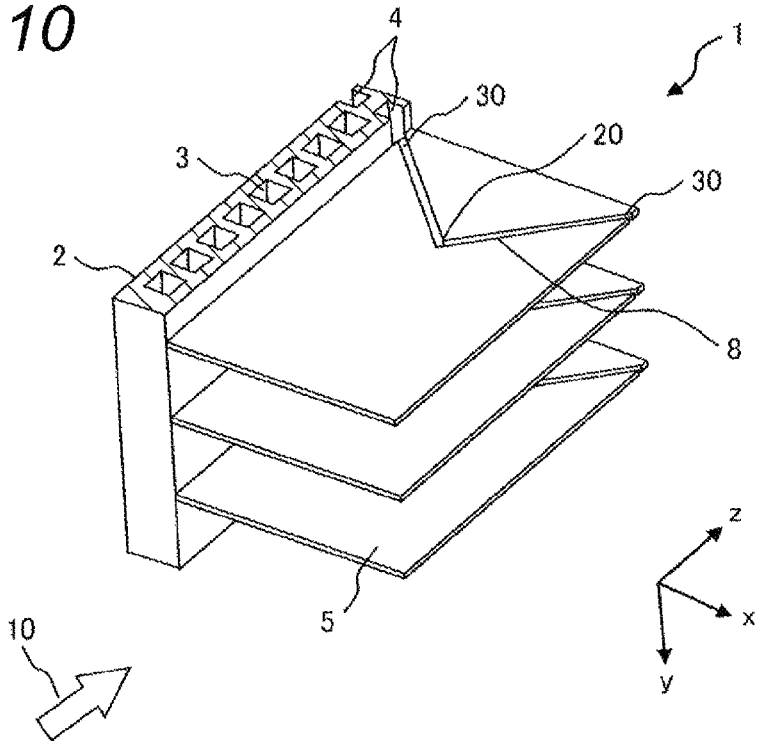
FIG. 10 is a partial perspective view of an air heat exchanger according to a fourth embodiment and a diagram illustrating a flat tube and a heat transfer fin.

FIG. 10 is a partial perspective view of an air heat exchanger 1 according to the fourth embodiment and illustrates a flat tube 2 and a heat transfer fin 5. In FIG. 10, the same reference numerals as those of FIG. 1 denote the same elements as those of FIG. 1 and explanation of these elements is omitted.

A water guiding groove 8 communicating with a water draining groove 4 from an upwind end portion 20 is formed in the heat transfer fin 5. A depth of the water guiding groove 8 decreases gradually from the upwind end portion 20 to a communicating portion 30 with the water draining groove 4. A position of the upwind end portion 20 of the water guiding groove 8 in an air blowing direction 10 (a Z-axis direction) is at the upwind side (the negative direction side of a Z axis) from the water draining groove 4.

Figure 11:
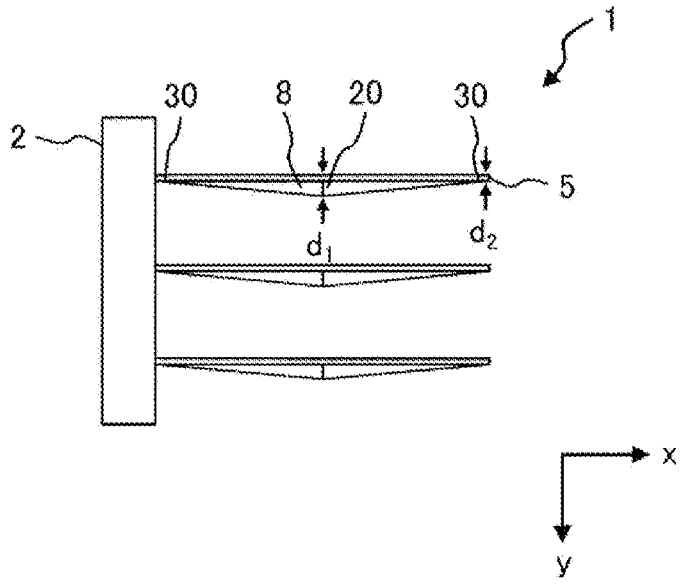
FIG. 11 is a partial lateral view of the air heat exchanger when viewed from an air blowing direction, in the fourth embodiment.

FIG. 11 is a partial lateral view of the air heat exchanger 1 illustrated in FIG. 10 when viewed from the air blowing direction 10 (the Z-axis direction). As illustrated in FIG. 11, when a depth of the upwind end portion 20 is represented by $d_1$ and a depth of the communicating portion 30 with the water draining groove 4 is represented by $d_2$ in the water guiding groove 8, $d_1>d_2$ is satisfied and the depth decreases gradually from the upwind end portion 20 to the communicating portion 30. Specific values of the depth $d_1$ of the upwind end portion 20 and the depth $d_2$ of the communicating portion 30 can be determined according to the velocity of the wind blown by the fan or the hydrophilic property of the heat transfer fin 5.

The principle of flowing the condensation water by the water guiding groove 8 when the depth of the water guiding groove 8 decreases gradually from the upwind end portion 20 to the communicating portion 30 is the same as the principle described using FIG. 6 and the expressions (1) and (2) in the first embodiment. However, in the expressions (1) and (2), a taper angle $\phi$ of the water guiding groove shows an angle representing a ratio in which the depth of the water guiding groove 8 decreases.

Figure 12:
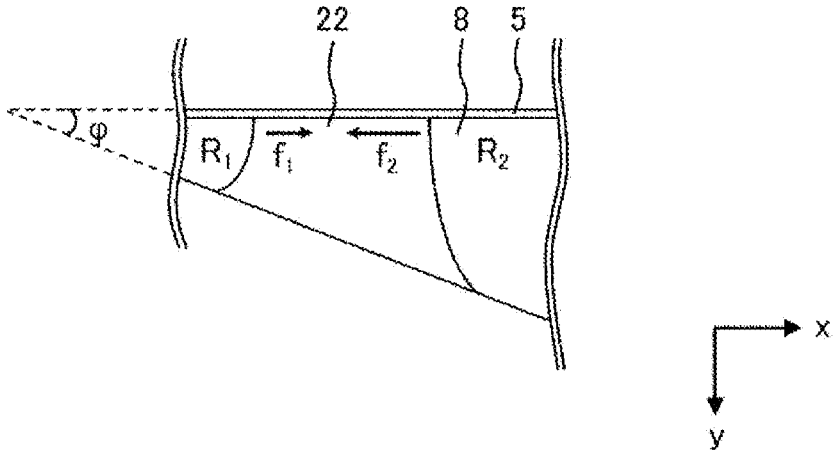
FIG. 12 is a partial lateral view of a heat transfer fin illustrating the water draining principle of condensation water generated on a surface of the heat transfer fin, in the fourth embodiment.

FIG. 12 is a diagram illustrating the water draining principle of condensation water 22 generated on a surface of the heat transfer fin 5 in this embodiment and a lateral view schematically illustrating a part of the water guiding groove 8 formed in the heat transfer fin 5. In FIG. 12, similarly to FIG. 11, the air heat exchanger 1 is viewed from the air blowing direction 10 (the Z-axis direction). As described above, in FIG. 12, the taper angle $\phi$ of the water guiding groove 8 shows an angle representing a ratio in which the depth of the water guiding groove 8 decreases.

As described using FIG. 6 and the expressions (1) and (2) in the first embodiment, the radius of curvature $R_1$ of an end of the small depth side (the side of the communicating portion 30) of the water guiding groove 8 in the water droplet of the condensation water 22 is smaller than the radius of curvature $R_2$ of an end of the large depth side (the side of the upwind end portion 20) ($R_1<R_2$). Therefore, the force $f_1$ applied from the small depth side to the condensation water 22 is smaller than the force $f_2$ applied from the large depth side to the condensation water 22 ($f_1<f_2$). For this reason, the force applied from the side of the upwind end portion 20 to the side of the communicating portion 30 is applied to the condensation water 22 and the condensation water 22 keeps getting wet from the large depth side to the small depth side (the side of the communicating portion 30) of the water guiding groove 8.

The depth of the water guiding groove 8 may decrease stepwise from the upwind end portion 20 to the communicating portion 30 with the water draining groove 4. The number of steps in which the depth of the water guiding groove 8 decreases can be determined arbitrarily.

The width of the water guiding groove 8 can be determined arbitrarily according to the velocity of the wind blown by the fan or the hydrophilic property of the heat transfer fin 5. The width of the water guiding groove 8 may be constant and may decrease from the upwind end portion 20 to the communicating portion 30, as illustrated in FIG. 1 or 9.

In addition, as illustrated in FIG. 11, on a bottom surface of the heat transfer fin 5, the water guiding groove 8 protrudes from the bottom surface of the heat transfer fin 5 to the lower side (a positive direction of a Y axis). After the condensation water 22 generated on the bottom surface of the heat transfer fin 5 is swept into the protruding water guiding groove 8 by the wind force of the fan, the condensation water is swept into the water draining groove 4 along the water guiding groove 8. For this reason, on the bottom surface of the heat transfer fin 5, the condensation water 22 generated on the surface of the heat transfer fin 5 is discharged efficiently from the water draining groove 4. The water guiding groove 8 may not protrude from the bottom surface of the heat transfer fin 5 to the lower side. According to manufacturing conditions of the heat transfer fin 5 such as the thickness of the heat transfer fin 5 or the processing method of the water guiding groove 8, it can be determined whether or not to protrude the water guiding groove 8 to the lower side.

Even in the air heat exchanger 1 according to this embodiment, after the condensation water 22 generated on the surface of the heat transfer fin 5 is swept into the water guiding groove 8 by the wind force of the fan, the condensation water keeps getting wet toward the communicating portion 30 with the water draining groove 4 by the surface tension applied to the condensation water 22 as illustrated in FIG. 12 and is drained efficiently through the water draining groove 4 formed in the flat tube 2. Therefore, the air heat exchanger according to this embodiment also has the same effect as that of the air heat exchanger according to the first embodiment.

Fifth Embodiment

An air heat exchanger according to a fifth embodiment of the present invention will be described. This embodiment is an example of an air heat exchanger in which a water guiding groove formed in a heat transfer fin communicates with a water draining groove of a flat tube by one communicating portion.

Figure 13:
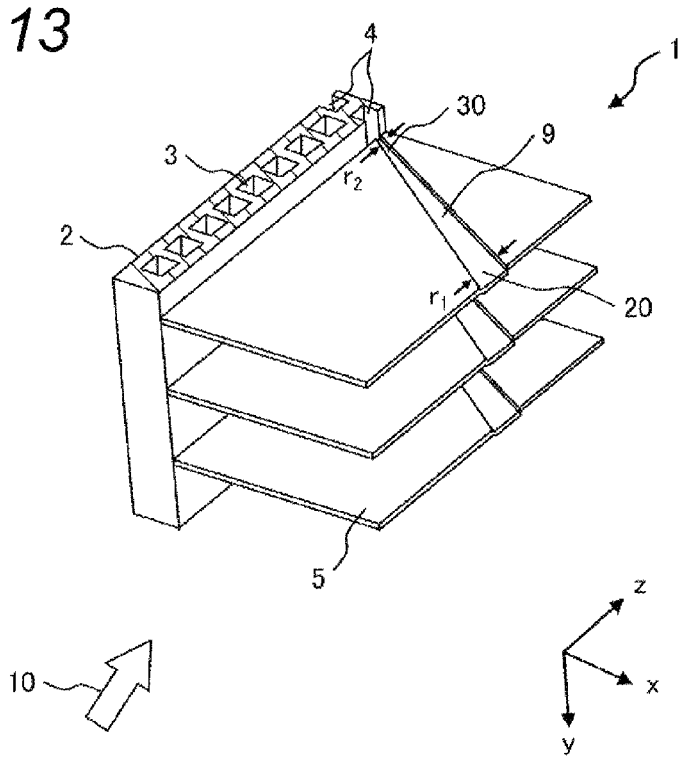
FIG. 13 is a partial perspective view of an air heat exchanger according to a fifth embodiment and a diagram illustrating a flat tube and a heat transfer fin.

FIG. 13 is a partial perspective view of an air heat exchanger 1 according to the fifth embodiment and illustrates a flat tube 2 and a heat transfer fin 5. In FIG. 13, the same reference numerals as those of FIG. 1 denote the same elements as those of FIG. 1 and explanation of these elements is omitted.

In the flat tube 2, a water draining groove 4 is formed in one side surface of an X-axis direction. The water draining groove 4 is opened in a positive direction of an X axis and a positive direction and a negative direction of a Y axis.

The heat transfer fin 5 has a water guiding groove 9 communicating with one water draining groove 4 provided in the flat tube 2. The water guiding groove 9 extends from an upwind end portion 20 to a communicating portion 30 with the water draining groove 4. The communicating portion 30 of the water guiding groove 9 with the water draining groove 4 is provided in only one place. Even in this embodiment, the upwind end portion 20 of the water guiding groove 9 is positioned at the upwind side (the negative direction side of a Z axis) of an air blowing direction 10 (a Z-axis direction) from the communicating portion 30 of the water guiding groove 9 with the water draining groove 4. A position of the upwind end portion 20 of the water guiding groove 9 in a width direction (an X-axis direction) of the heat transfer fin 5 is a connecting portion of the heat transfer fin 5 and the flat tube 2 to be the side opposite to the communicating portion 30 in the width direction (the X-axis direction).

That is, the water guiding groove 9 is arranged from the upwind end portion 20 existing in one end of the width direction (the X-axis direction) of the heat transfer fin 5 to the communicating portion 30 with the water draining groove 4 existing in the other end and from the upwind side (the negative direction side of the Z axis) to the downwind side (the positive direction side of the Z axis) of the air blowing direction 10 (the Z-axis direction). Therefore, as illustrated in FIG. 13, the water guiding groove 9 is inclined with respect to the width direction (the X-axis direction) of the heat transfer fin 5 and the air blowing direction 10 (the Z-axis direction).

The width of the water guiding groove 9 decreases gradually from the upwind end portion 20 to the communicating portion 30 with the water draining groove 4, as illustrated in FIG. 13. That is, in the water guiding groove 9, a width $r_1$ of the upwind end portion 20 and a width $r_2$ of the communicating portion 30 are in a relation of $r_1>r_2$ and the width decreases gradually from the upwind end portion 20 to the communicating portion 30. Preferably, the widths $r_1$ and $r_2$ are in a relation of $r_1>2r_2$. Specific values of the width $r_1$ of the upwind end portion 20 and the width $r_2$ of the communicating portion 30 can be determined according to the velocity of the wind blown by the fan or the hydrophilic property of the heat transfer fin 5.

The depth of the water guiding groove 9 can be arbitrarily determined according to the velocity of the wind blown by the fan or the thickness and the hydrophilic property of the heat transfer fin 5.

The water guiding groove 9 is formed in the heat transfer fin 5, so that the condensation water can be discharged from the water guiding groove 9 to the water draining groove 4 according to the same principle as the principle described using FIG. 6 and the expressions (1) and (2) in the first embodiment.

Therefore, even in the air heat exchanger 1 according to this embodiment, after the condensation water generated on the surface of the heat transfer fin 5 is swept into the water guiding groove 9 by the wind force of the fan, the condensation water keeps getting wet toward the communicating portion 30 with the water draining groove 4 by the surface tension applied to the condensation water and is drained efficiently through the water draining groove 4 formed in the flat tube 2. For this reason, the air heat exchanger according to this embodiment also has the same effect as that of the air heat exchanger according to the first embodiment.

In this embodiment, the case in which the width of the water guiding groove 9 decreases gradually toward the communicating portion 30 has been described. However, the depth may decrease toward the communicating portion 30. In addition, the width or the depth of the water guiding groove 9 may decrease stepwise toward the communicating portion 30. At any rate, an area of a cross section of the water guiding groove 9 may decrease from the upwind end portion 20 to the communicating portion 30.

In addition, in this embodiment, in the flat tube 2, the water draining groove 4 is formed on one side surface of the X-axis direction. However, the water draining grooves 4 may be formed on both side surfaces of the X-axis direction. In this case, the water guiding groove 9 may communicate with the water draining groove 4 of the flat tube 2 by the upwind end portion 20. That is, the water guiding groove 9 may communicate with the water draining groove 4 by both ends (the upwind end portion 20 and the communicating portion 30).

Sixth Embodiment

An air heat exchanger according to a sixth embodiment of the present invention will be described. In this embodiment, two modifications of the water guiding groove formed in the heat transfer fin in the air heat exchanger illustrated in the first embodiment are illustrated.

Figure 14:
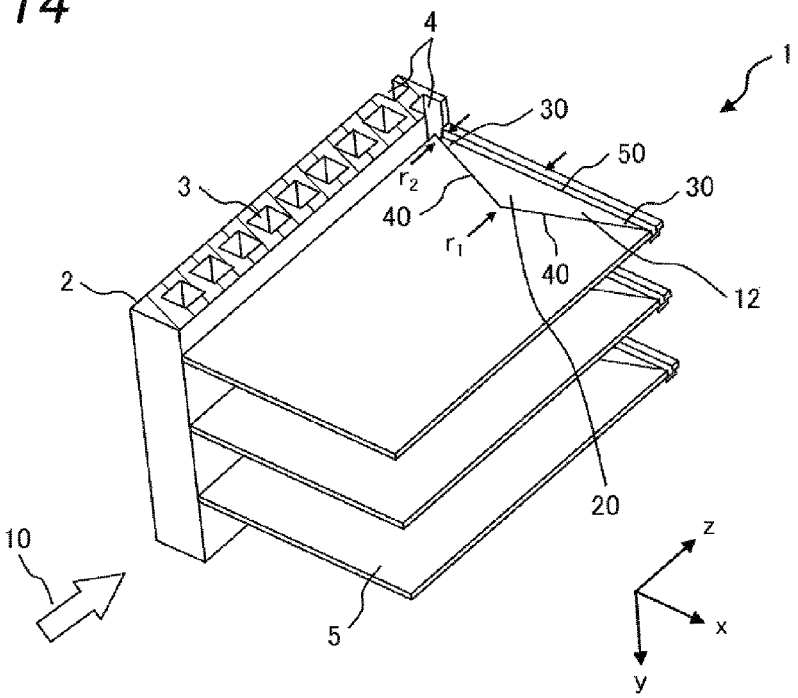
FIG. 14 is a partial perspective view of an air heat exchanger according to a sixth embodiment and a diagram illustrating a flat tube and a heat transfer fin.

FIG. 14 is a partial perspective view of an air heat exchanger 1 according to the sixth embodiment and illustrates a flat tube 2 and a heat transfer fin 5. In FIG. 14, the same reference numerals as those of FIG. 1 denote the same elements as those of FIG. 1 and explanation of these elements is omitted.

In the heat transfer fin 5, a water guiding groove 12 communicating with a water draining groove 4 is formed. Differently from the water guiding groove 6 illustrated in FIG. 1, in the water guiding groove 12, a groove wall 50 on the downwind side (the positive direction side of a Z axis) among groove walls forming the water guiding groove 12 exists at the same position as that of a water draining groove 4 in an air blowing direction 10. Therefore, an entire shape of the water guiding groove 12 viewed from an upward direction (a negative direction of a Y axis) is a shape of a triangle including the groove wall 50 and two groove walls 40 on the upwind side (the negative direction side of the Z axis). The groove wall 50 of the downwind side may be parallel to an X axis or may not be parallel to the X axis.

Figure 15:
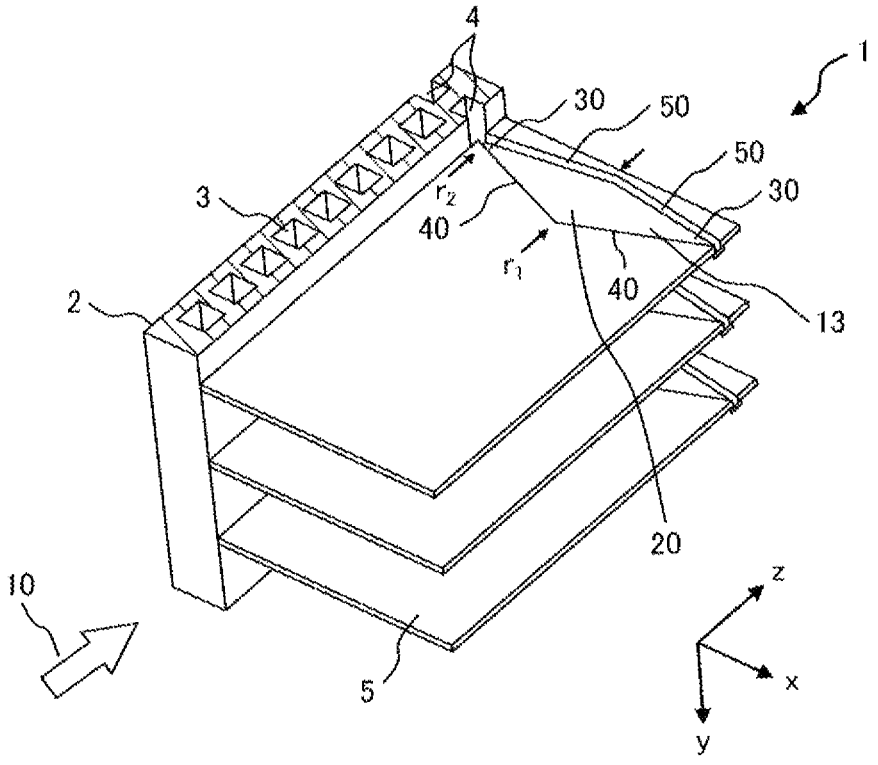
FIG. 15 is a partial perspective view of another air heat exchanger according to the sixth embodiment and a diagram illustrating a flat tube and a heat transfer fin.

FIG. 15 is a partial perspective view of another air heat exchanger 1 according to the sixth embodiment and illustrates a flat tube 2 and a heat transfer fin 5. In FIG. 15, the same reference numerals as those of FIG. 1 denote the same elements as those of FIG. 1 and explanation of these elements is omitted.

In the heat transfer fin 5, a water guiding groove 13 communicating with a water draining groove 4 is formed. Differently from the water guiding groove 6 illustrated in FIG. 1, in the water guiding groove 13, a groove wall 50 on the downwind side (the positive direction side of a Z axis) among groove walls forming the water guiding groove 13 is positioned at the downwind side from the water draining groove 4. Therefore, an entire shape of the water guiding groove 13 viewed from an upward direction (a negative direction of a Y axis) is a shape of a convex quadrangle including the two groove walls 50 and two groove walls 40 on the upwind side (the negative direction side of the Z axis).

In the water guiding groove 12 illustrated in FIG. 14 and the water guiding groove 13 illustrated in FIG. 15, a position of an upwind end portion 20 in an air blowing direction 10 (a Z-axis direction) is at the upwind side (the negative direction side of the Z axis) from the water draining groove 4.

The widths of the water guiding groove 12 and the water guiding groove 13 decrease gradually from the upwind end portion 20 to the communicating portion 30 with the water draining groove 4. That is, in the water guiding groove 12 and the water guiding groove 13, a width $r_1$ of the upwind end portion 20 and a width $r_2$ of the communicating portion 30 are in a relation of $r_1>r_2$ and the width decreases gradually from the upwind end portion 20 to the communicating portion 30. Preferably, the widths $r_1$ and $r_2$ are in a relation of $r_1>2r_2$. Specific values of the width $r_1$ of the upwind end portion 20 and the width $r_2$ of the communicating portion 30 can be determined according to the velocity of the wind blown by the fan or the hydrophilic property of the heat transfer fin 5.

The water guiding groove 12 or the water guiding groove 13 is formed in the heat transfer fin 5, so that the condensation water can be discharged from the water guiding groove 12 or the water guiding groove 13 to the water draining groove 4 according to the same principle as the principle described using FIG. 6 and the expressions (1) and (2) in the first embodiment.

Therefore, even in the air heat exchanger 1 according to this embodiment, after the condensation water generated on the surface of the heat transfer fin 5 is swept into the water guiding groove 12 or the water guiding groove 13 by the wind force of the fan, the condensation water keeps getting wet toward the communicating portion 30 with the water draining groove 4 by the surface tension applied to the condensation water and is discharged efficiently through the water draining groove 4 formed in the flat tube 2. For this reason, the air heat exchanger according to this embodiment also has the same effect as that of the air heat exchanger according to the first embodiment.

In the water guiding groove 13 illustrated in FIG. 15, because the groove wall 50 of the downwind side (the positive direction side of the Z axis) is positioned at the downwind side from the water draining groove 4, there is concern that water draining efficiency is deteriorated. However, a portion of the water guiding groove 13 at the downwind side from the water draining groove 4 is formed in a shape having a minimum size (that is, the groove wall 50 is not positioned at the downwind side from the water draining groove 4), so that water draining efficiency of the water guiding groove 13 can be suppressed from being deteriorated, and the condensation water can be discharged from the water guiding groove 13 to the water draining groove 4.

In the first to sixth embodiments, the water guiding groove extends in a straight line shape, from the upwind end portion 20 to the communicating portion 30, in a surface (a ZX plane) of the heat transfer fin 5 (for example, the water guiding groove extends divisionally as the two straight lines from the upwind end portion 20 in FIG. 1 and extends as one straight line from the upwind end portion 20 in FIG. 13). The water guiding groove does not need to extend in the straight line shape and may extend in a polygonal line shape or a curved shape. However, if a portion extending from the downwind side to the upwind side (a portion extending from the positive direction side to the negative direction side of the Z axis) exists in the water guiding groove, the condensation water in the water guiding groove should keep getting wet against the wind force of the fan. For this reason, water draining efficiency is deteriorated and it is not preferable.

In addition, a shape of a cross section of the water guiding groove perpendicular to an extension direction is arbitrary. For example, the shape of the cross section can be configured as a polygonal shape such as a quadrangle and a triangle or a curved shape such as a circular shape and an elliptical shape.

REFERENCE SIGNS LIST

1 air heat exchanger
2 flat tube

3 flow channel of cooling medium
4, 4*a*, 4*b* water draining groove
5 heat transfer fin
6, 6*a*, 6*b* water guiding groove
7 water guiding groove
8 water guiding groove
9 water guiding groove
10 air blowing direction
11 header
12 water guiding groove
13 water guiding groove
20, 20*a*, 20*b* upwind end portion of water guiding groove
22 condensation water
30, 30*a*, 30*b* communicating portion of water guiding groove with water draining groove
40 groove wall on upwind side among groove walls forming water guiding groove
50 groove wall on downwind side among groove walls forming water guiding groove
100 air heat exchanger according to related art
200 flat tube
300 flow channel of cooling medium
500 heat transfer fin

The invention claimed is:

1. An air heat exchanger including a plurality of flat tubes and heat transfer fins provided between the flat tubes and on which air is blown, wherein the flat tubes include water draining grooves on side surfaces on which the heat transfer fins are provided, the heat transfer fins include water guiding grooves communicating with the water draining grooves, at least a groove wall on the upwind side of an air blowing direction among groove walls forming the water guiding grooves is provided from a position of the upwind side from the water draining grooves to the water draining grooves, and the water guiding grooves extend toward the water draining grooves along the groove wall on the upwind side and an area of a cross section perpendicular to an extension direction decreases toward the water draining grooves.

2. The air heat exchanger according to claim 1, wherein the heat transfer fins include water guiding grooves communicating with the water draining grooves of each of the two flat tubes with the heat transfer fins therebetween.

3. The air heat exchanger according to claim 1, wherein widths of the water guiding grooves decrease toward the water draining grooves.

4. The air heat exchanger according to claim 1, wherein depths of the water guiding grooves decrease toward the water draining grooves.

5. The air heat exchanger according to claim 1, wherein the area of the cross section of the water guiding grooves decreases smoothly toward the water draining grooves.

6. The air heat exchanger according to claim 1, wherein the area of the cross section of the water guiding grooves decreases stepwise toward the water draining grooves.

7. The air heat exchanger according to claim 1, wherein the heat transfer fins include the plurality of water guiding grooves in the air blowing direction.

8. The air heat exchanger according to claim 1, wherein the water guiding grooves protrude from the heat transfer fins, in surfaces of the heat transfer fins opposite to surfaces including the water guiding grooves.

* * * * *